US011322120B1

(12) United States Patent
Meyer

(10) Patent No.: US 11,322,120 B1
(45) Date of Patent: May 3, 2022

(54) CANTILEVERED BRIDGE FOR RESONATORS

(71) Applicant: Michael Meyer, Santa Cruz, CA (US)

(72) Inventor: Michael Meyer, Santa Cruz, CA (US)

( * ) Notice: Subject to any disclaimer, the term of this patent is extended or adjusted under 35 U.S.C. 154(b) by 0 days.

(21) Appl. No.: 17/330,358

(22) Filed: May 25, 2021

(51) Int. Cl.

| | |
|---|---|
| ***G10D 3/02*** | (2006.01) |
| ***G10D 3/04*** | (2020.01) |
| ***G10D 3/13*** | (2020.01) |
| ***G10D 1/08*** | (2006.01) |

(52) U.S. Cl.
CPC ..... *G10D 3/04* (2013.01); *G10D 1/085* (2013.01); *G10D 3/02* (2013.01); *G10D 3/13* (2020.02)

(58) Field of Classification Search
CPC G10D 3/04; G10D 3/13; G10D 1/085; G10D 3/02
See application file for complete search history.

(56) References Cited

U.S. PATENT DOCUMENTS 1,741,453 A * 12/1929 Dopyera ..... G10D 3/02 84/267
1,762,617 A * 6/1930 Dopyera ..... G10D 3/02 84/270
1,808,756 A * 6/1931 Beauchamp ..... G10D 3/02 84/296
1,808,757 A * 6/1931 Beauchamp ..... G10D 3/02 984/112
1,872,633 A * 8/1932 Dopyera ..... G10D 3/02 984/112
1,896,484 A * 2/1933 Dopyera ..... G10D 3/02 84/296
2,027,723 A * 1/1936 Dopyera ..... G10D 3/02 84/296
2,029,469 A * 2/1936 Dopyera ..... G10D 3/02 984/112
2,031,706 A * 2/1936 Hambrecht ..... G10D 1/08 84/267
2,042,080 A * 5/1936 Turner ..... G10D 3/02 84/296
2,045,265 A * 6/1936 Dopyera ..... G10D 3/02 84/267
2,138,907 A * 12/1938 Dopyera ..... G10D 3/02 84/723
2,139,099 A * 12/1938 Robertson ..... G10D 3/02 84/299
2,158,322 A * 5/1939 Dopyera ..... G10D 3/02 984/112
3,314,324 A * 4/1967 Williams ..... G10D 3/02 84/294
3,435,721 A * 4/1969 Dopera ..... G10D 3/02 D17/14

(Continued)

*Primary Examiner* — Robert W Horn
(74) *Attorney, Agent, or Firm* — Kevin Roe

(57) ABSTRACT

A cantilevered bridge for resonators to permit greater sound production from small sound producing instruments, including a sound producing instrument having an instrument body; a cantilevered bridge lever arm having a first surface and a second surface, with a primary resonator coupled by a biscuit bridge to the first surface of the cantilevered bridge lever arm, and a secondary resonator coupled by a connector to the second surface of the cantilevered bridge lever arm. In a second embodiment, a hinge attachment anchors the cantilevered bridge lever arm to a pivot point within the sound producing instrument.

20 Claims, 9 Drawing Sheets

(56) References Cited

U.S. PATENT DOCUMENTS

| | | | | | |
|---|---|---|---|---|---|
| 3,931,753 | A * | 1/1976 | Dopera | G10D 3/02 | 84/297 R |
| 4,068,553 | A * | 1/1978 | Dopyera | G10D 3/02 | 984/115 |
| 4,172,404 | A * | 10/1979 | Dopyera | G10D 3/06 | 984/115 |
| 4,282,792 | A * | 8/1981 | Voorthuyzen | G10D 1/02 | 984/103 |
| 4,823,668 | A * | 4/1989 | Marrs | G10D 3/02 | 84/173 |
| 5,078,041 | A * | 1/1992 | Schmued | G10H 3/185 | 84/DIG. 24 |
| 5,780,758 | A * | 7/1998 | McGill | G10D 3/02 | 84/296 |
| 7,507,885 | B2 * | 3/2009 | Coke | G10D 1/085 | 84/290 |
| 8,278,538 | B1 * | 10/2012 | D'Anda | G10D 3/02 | 84/267 |
| 8,907,187 | B2 * | 12/2014 | Woods | G10D 3/02 | 84/263 |
| 9,570,051 | B1 * | 2/2017 | Moore | G10D 3/02 | |
| 9,847,076 | B1 * | 12/2017 | McCabe | G10D 1/085 | |
| 10,748,512 | B1 * | 8/2020 | Watkins | G10D 3/06 | |
| 2008/0053289 | A1 * | 3/2008 | Bryan | G10D 1/08 | 84/291 |

* cited by examiner

CANTILEVERED BRIDGE FOR RESONATORS

BACKGROUND OF THE INVENTION

Description of the Prior Art

Sound producing instruments, such as stringed musical instruments or loudspeakers, sometimes utilize a resonator to enhance the sound production. For example, resonator guitars, also known as resophonic guitars, typically incorporate a resonator inside the guitar to enhance the sounds produced by the guitar.

However, prior art sound producing instruments, such as the resophonic guitars, have quite small bodies and are therefore quite limited in the number and size of resonators that can be contained inside the sound producing instruments. Therefore, the sound production capability of the prior art sound producing instruments is constrained by the size of the instruments.

In view of the foregoing, what is needed is an improved apparatus for incorporating resonators to provide a more compact arrangement to fit within the small bodies of the sound producing instruments.

BRIEF DESCRIPTION OF THE DRAWINGS

Non-limiting and non-exhaustive embodiments of the invention are described with reference to the following figures.

DETAILED DESCRIPTION OF PREFERRED EMBODIMENTS

The invention provides a method and apparatus to provide a cantilevered bridge for resonators that provides improved sound production capabilities for sound producing instruments. Herein, a resonator is defined to include any resonant chamber, diaphragm, speaker, or cone. For example, one embodiment of the invention can be used in stringed instruments, such as guitars, to incorporate two resonators inside the stringed instrument. It should be noted that other embodiments of the invention can be assembled using components fabricated from plastic, polymers, fiber materials, ceramics, glasses, metals or equivalent materials in addition to wood. Alternative embodiments may or may not use components fabricated from extruded aluminum or aluminum alloys that are machined. Alternative embodiments could incorporate components fabricated from other materials, such as various steel or magnesium alloys or equivalent materials having sufficient strength and rigidity.

One embodiment of the invention allows two or more resonators to be actuated by a single cantilevered bridge lever arm. One embodiment of the invention within a stringed musical instrument comprises a cantilevered bridge lever arm that allows the bridge of the stringed musical instrument to transfer sound vibration from the strings to one or more resonators.

Figure 1A:
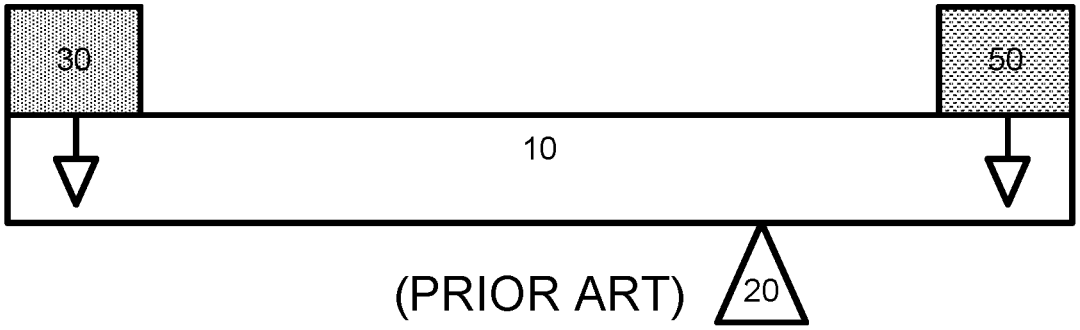
(PRIOR ART) FIG. 1A
FIG. 1A illustrates a Class 1 lever, in accordance with the prior art.

FIG. 1A illustrates a Class 1 lever. Class 1 levers have a lever 10 with the fulcrum 20 between the force 30 and the load 50. In summary, in a Class 1 lever, the effort (force 30) moves over a large distance to move the load 50 a smaller distance, and the fulcrum 20 is between the effort (force 30) and the load 50. An example of a Class 1 lever would be a crowbar (not shown).

Figure 1B:
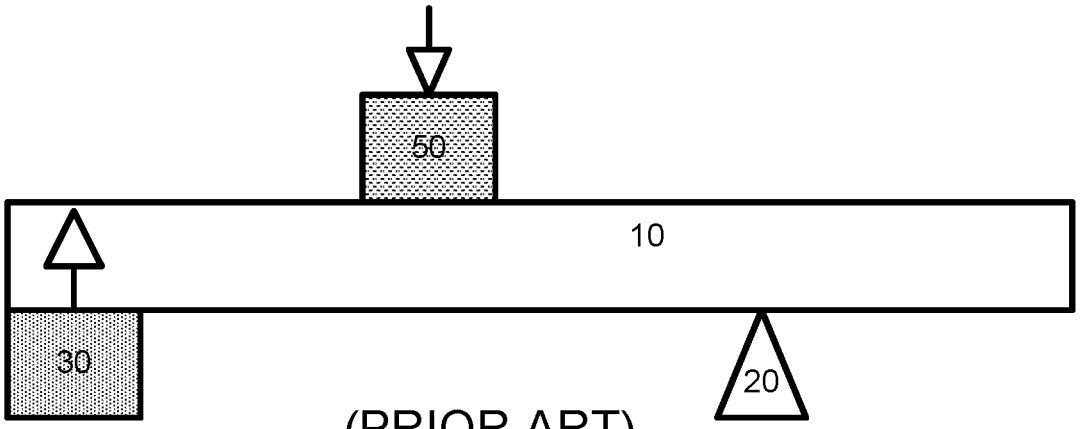
(PRIOR ART) FIG. 1B
FIG. 1B illustrates a Class 2 lever, in accordance with the prior art.

FIG. 1B illustrates a Class 2 lever. Class 2 levers have a lever 10 with the load 50 between the effort (force 30) and the fulcrum 20, where both are on the same side of the fulcrum 20. A common example is a wheelbarrow (not shown), where the effort (force 30) moves a large distance to lift a heavy load 50, with the axle and wheel acting as the fulcrum 20. In a Class 2 lever, the effort (force 30) moves over a larger distance to raise the load 50 a smaller distance. Note that the length of the effort arm goes all the way to the fulcrum 20 and always exceeds the length of the load arm in a Class 2 lever. In summary, in a Class 2, the effort (force 30) moves over a larger distance to move the load 50 a smaller distance, and the effort (force 30) and the load 50 are on the same side of the fulcrum 20.

Figure 1C:
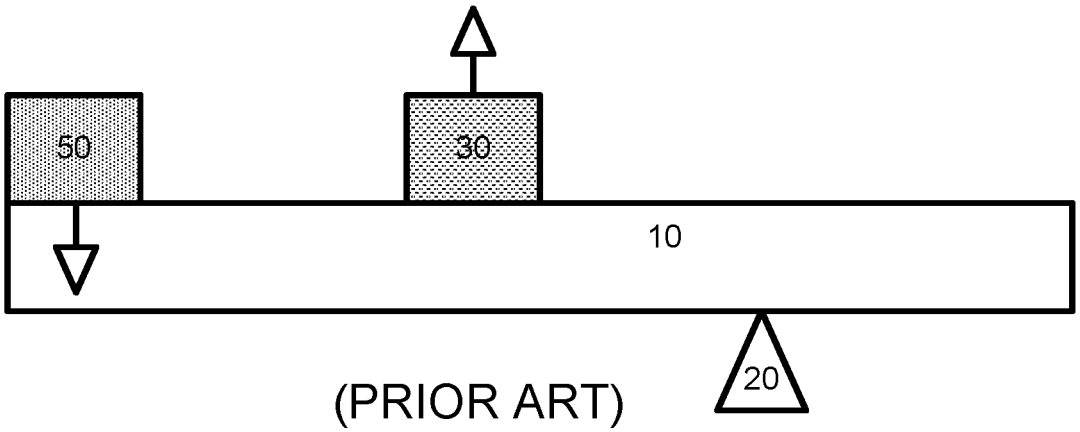
(PRIOR ART) FIG. 1C
FIG. 1C illustrates a Class 3 lever, in accordance with the prior art.

FIG. 1C illustrates a Class 3 lever. Class 3 levers have a lever 10 with the effort (force 30) between the load 50 and the fulcrum 20, where both are on the same side of the fulcrum 20. Note that the length of the load arm goes all the way to the fulcrum 20 and always exceeds the length of the effort (force 30) arm in a Class 3 lever. A common example is a human arm (not shown), where the load 50 moves a larger distance and the effort (force 30) moves a shorter distance, where arm muscles supply the effort (force 30) and either the human elbow or the human shoulder act as the fulcrum 20.

Figures 2, 3:
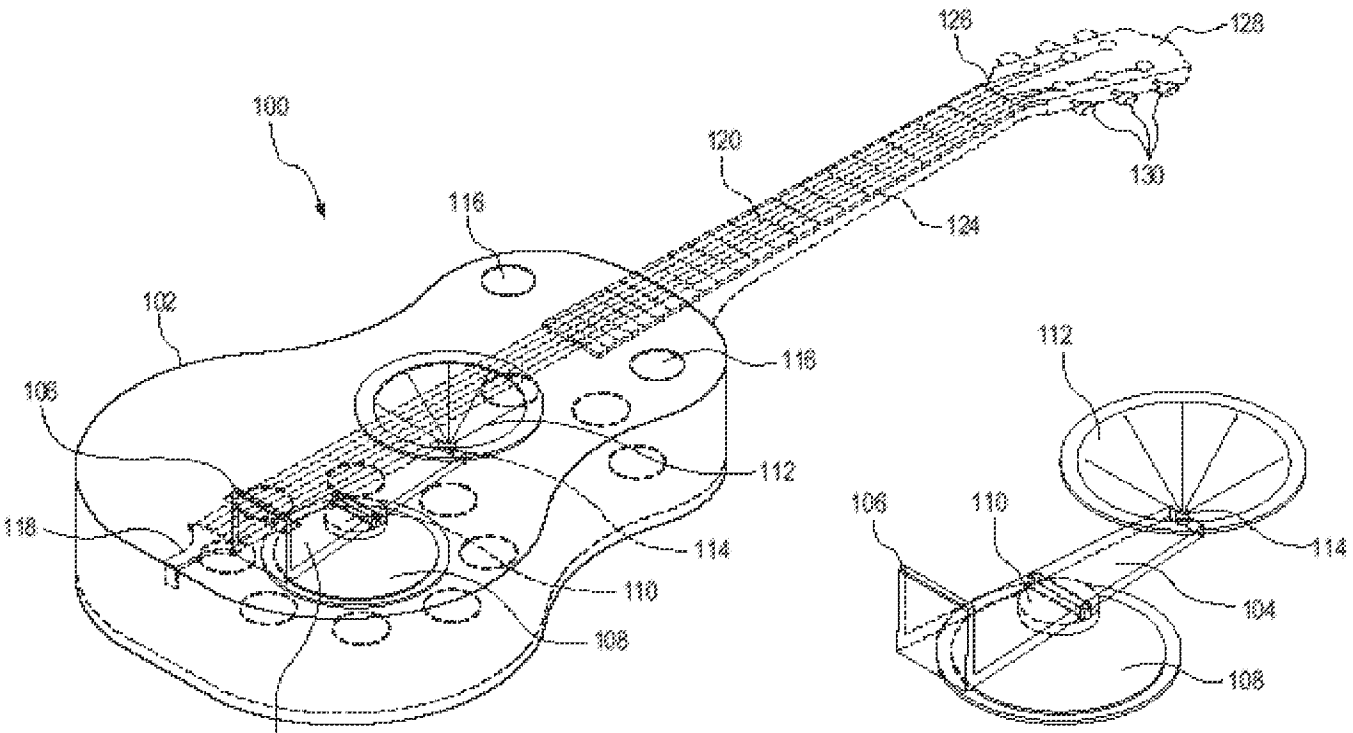
FIG. 2 illustrates an isometric view of a guitar including a cantilevered bridge for resonators, in accordance with a first embodiment of the invention.
FIG. 3 illustrates a magnified isometric view of a cantilevered bridge for resonators in more detail, in accordance with a first embodiment of the invention.

FIG. 2 illustrates an isometric view of a guitar including a cantilevered bridge for resonators, in accordance with a first embodiment of the invention. This embodiment illustrates a Class 1 lever where the transferred sound force is from string tension on the bridge, which puts pressure on two resonators, one at the fulcrum and another at the load end of the lever. The sound producing instrument 100 shown in FIG. 2 includes an instrument body 102, a cantilevered bridge lever arm 104, a bridge saddle 106 for the strings 120 to rest, a primary resonator 108 which is shown on the bottom in a standard position, a biscuit bridge 110 on top of the primary resonator 108, a secondary resonator 112 on the top and on the opposite end from the bridge saddle 106, a connector 114 (e.g., screw, nail, pin or equivalent) to secure the secondary resonator 112 to the end of the cantilevered bridge lever arm 104, one or more sound holes 116 which are holes in the instrument body that emit sounds, a tailpiece 118 which anchors the strings 120 at the body 102, a neck 124, a nut 126, a headstock 128, and one or more tuning machines 130. In FIG. 2, with two resonators, the primary resonator is the Fulcrum and the secondary resonator is the Load. This configuration represents a Class 1 lever.

However, in various embodiments, multiple resonators are advantageous in that they provide more vibration surface area, which enables a greater sound volume and depth of tone. Also, in alternative embodiments of the invention, a variety of resonators with varying "voices" i.e., sound characteristics, can be combined for a broader frequency spectrum of tone quality. Another advantage of various embodiments of the invention, is the ability to get more sound producing surface area into a smaller-bodied sound producing instrument.

FIG. 3 illustrates a magnified isometric view of a cantilevered bridge for resonators in more detail, in accordance with a first embodiment of the invention. The cantilevered bridge includes a cantilevered bridge lever arm 104, a bridge saddle 106 for the strings (not shown) to rest, a primary resonator 108 which is shown on the bottom in a standard position, a biscuit bridge 110 on top of the primary resonator 108, a secondary resonator 112 on the top and on the opposite end from the bridge saddle 106, a connector 114 (e.g., screw, nail, pin or equivalent) to secure the secondary resonator 112 to the end of the cantilevered bridge lever arm 104.

Figure 4:
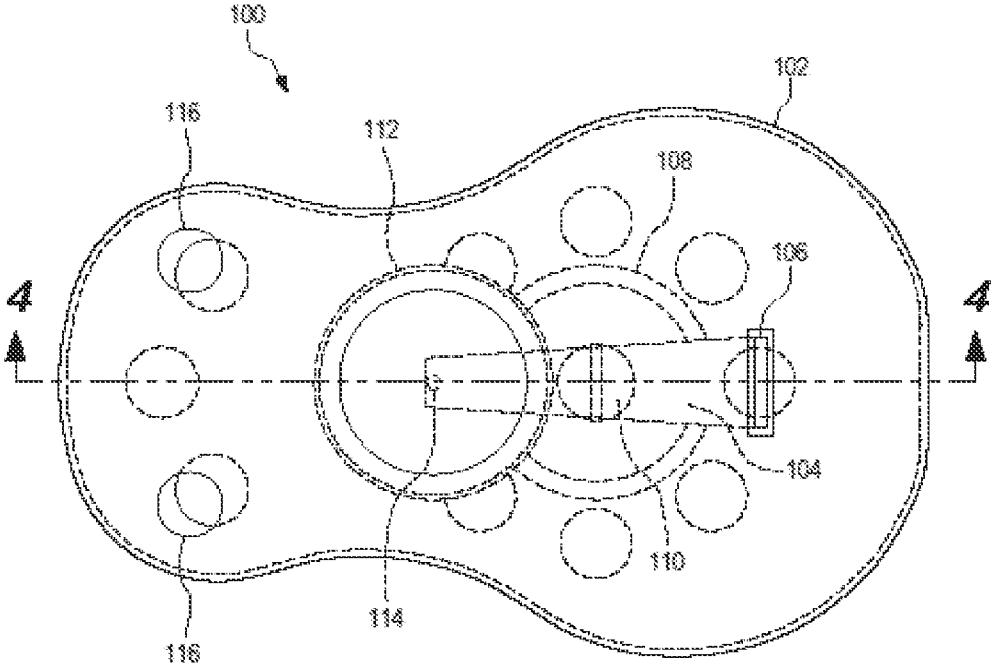
FIG. 4 illustrates a top down view of a guitar body including a cantilevered bridge for resonators, in accordance with a first embodiment of the invention.

FIG. 4 illustrates a top down view of a guitar body including a cantilevered bridge for resonators, in accordance with a first embodiment of the invention. The sound producing instrument shown in FIG. 4 includes a sound producing instrument 100, an instrument body 102, a cantilevered bridge lever arm 104, a bridge saddle 106 for the strings 120 to rest, a primary resonator 108 which is shown on the bottom in a standard position, a biscuit bridge 110 on top of the primary resonator 108, a secondary resonator 112 on the top and on the opposite end from the bridge saddle 106, a connector 114 (e.g., screw, nail, pin or equivalent) to secure the secondary resonator 112 to the end of the cantilevered bridge lever arm 104, one or more sound holes 116 which are holes in the instrument body that emit sounds. In the embodiment as shown in FIG. 4, a Class 2 lever is actuating a single standard sized resonator. The lever is hinged at one end to a fixed point (the fulcrum), and the resonator is the load, and again the string tension on the bridge is the applied force. This allows for a large resonator to be installed inside a smaller bodied instrument. In FIG. 4, with one resonator, the hinge point is the fulcrum (like the axle of a wheelbarrow), the biscuit bridge 110 is the load, and the bridge saddle 106 that supports the strings 120 is the effort. This configuration represents a Class 2 lever.

Figure 5:
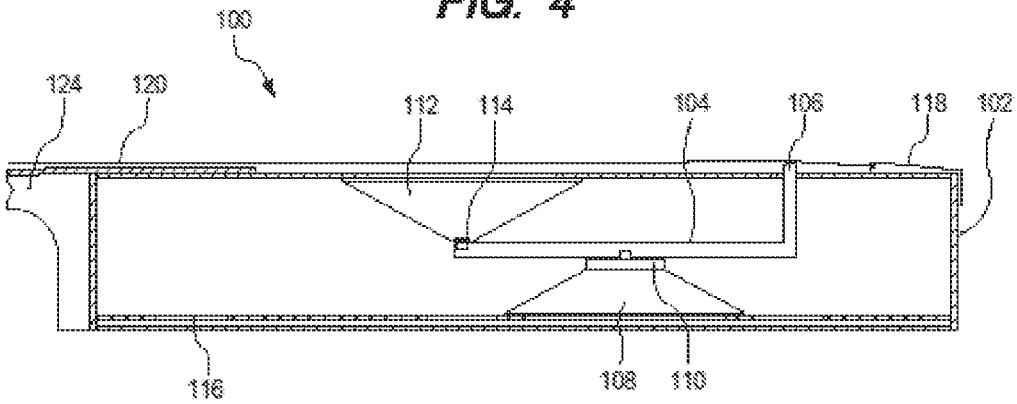
FIG. 5 illustrates a horizontal cross-sectional side view of a cantilevered bridge for resonators, in accordance with a first embodiment of the invention.

FIG. 5 illustrates a horizontal cross-sectional side view of a cantilevered bridge for resonators, in accordance with a first embodiment of the invention. The sound producing instrument shown in FIG. 4 includes a sound producing instrument 100, an instrument body 102, a cantilevered bridge lever arm 104, a bridge saddle 106 for the strings 120 to rest, a primary resonator 108 which is shown on the bottom in a standard position, a biscuit bridge 110 on top of the primary resonator 108, a secondary resonator 112 on the top and on the opposite end from the bridge saddle 106, a connector 114 (e.g., screw, nail, pin or equivalent) to secure the secondary resonator 112 to the end of the cantilevered bridge lever arm 104, one or more sound holes 116 which are holes in the instrument body that emit sounds, a tailpiece 118 which anchors the strings 120 at the body 102 and a neck 124.

Figure 6:
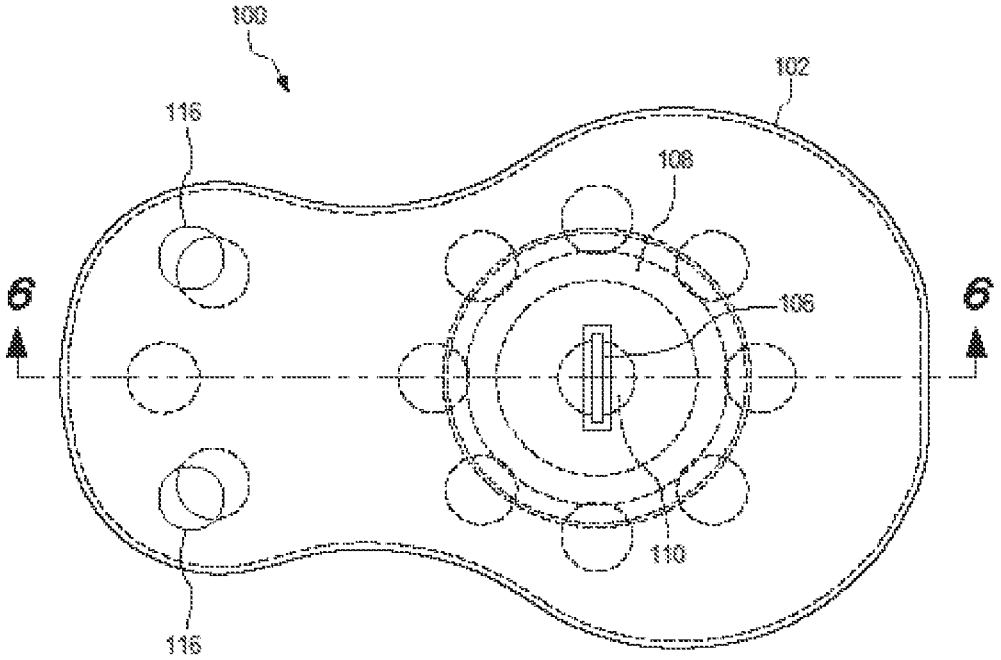
FIG. 6 illustrates a top down view of a guitar body including a single resonator, in accordance with a first embodiment of the invention.

FIG. 6 illustrates a top down view of a guitar body including a single resonator, in accordance with a first embodiment of the invention. The sound producing instrument shown in FIG. 6 includes a sound producing instrument 100, an instrument body 102, a cantilevered bridge lever arm 104, a bridge saddle 106 for the strings 120 to rest, a primary resonator 108 which is shown on the bottom in a standard position, a biscuit bridge 110 on top of the primary resonator 108, one or more sound holes 116 which are holes in the instrument body that emit sounds. In FIG. 6, with one resonator, the hinge point is again the fulcrum, the bridge saddle 106 is the effort, and the biscuit bridge 110 is the load. This configuration represents a Class 3 lever.

Figure 7:
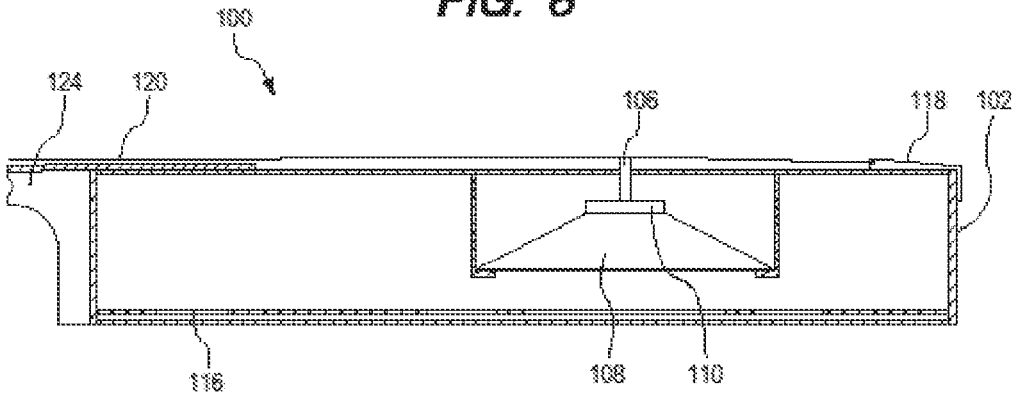
FIG. 7 illustrates a horizontal cross-sectional side view of a single resonator, in accordance with a first embodiment of the invention.

FIG. 7 illustrates a horizontal cross-sectional side view of a single resonator, in accordance with a first embodiment of the invention. The sound producing instrument shown in FIG. 7 includes a sound producing instrument 100, an instrument body 102, a cantilevered bridge lever arm 104, a bridge saddle 106 for the strings 120 to rest, a primary resonator 108 which is shown on the bottom in a standard position, a biscuit bridge 110 on top of the primary resonator 108, one or more sound holes 116 which are holes in the instrument body that emit sounds, a tailpiece 118 which anchors the strings 120 at the body 102 and a neck 124.

Figure 8:
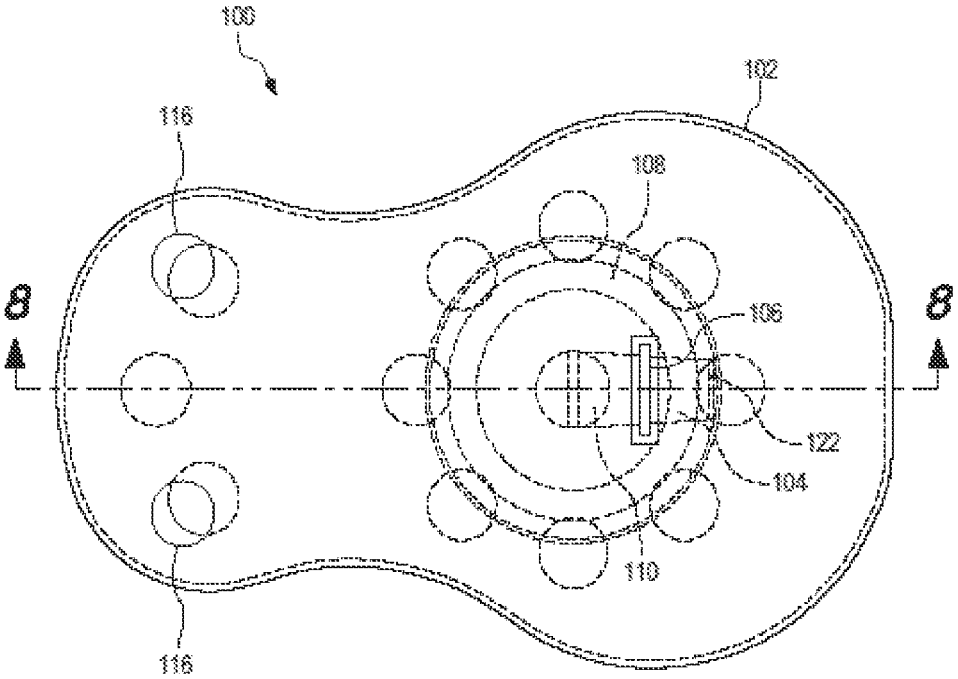
FIG. 8 illustrates a top down view of a guitar body including a single resonator, in accordance with a first embodiment of the invention.

FIG. 8 illustrates a top down view of a guitar body including a single resonator, in accordance with a first embodiment of the invention. The sound producing instrument shown in FIG. 4 includes a sound producing instrument 100, an instrument body 102, a cantilevered bridge lever arm 104, a bridge saddle 106 for the strings 120 to rest, a primary resonator 108 which is shown on the bottom in a standard position, a biscuit bridge 110 on top of the primary resonator 108, one or more sound holes 116 which are holes in the instrument body that emit sounds.

Figure 9:
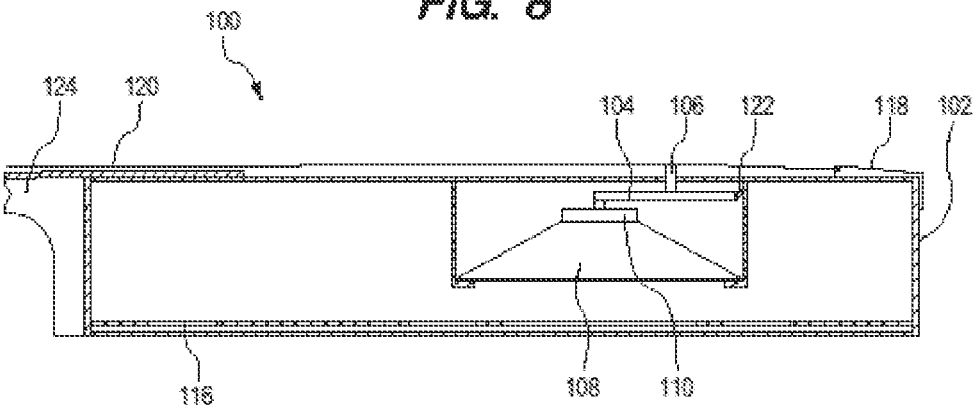
FIG. 9 illustrates a horizontal cross-sectional side view of a single resonator, in accordance with a first embodiment of the invention.

FIG. 9 illustrates a horizontal cross-sectional side view of a single resonator, in accordance with a first embodiment of the invention. The sound producing instrument shown in FIG. 4 includes a sound producing instrument 100, an instrument body 102, a cantilevered bridge lever arm 104, a bridge saddle 106 for the strings 120 to rest, a primary resonator 108 which is shown on the bottom in a standard position, a biscuit bridge 110 on top of the primary resonator 108, a connector 114 (e.g., screw, nail, pin or equivalent) to secure the secondary resonator 112 to the end of the cantilevered bridge lever arm 104, one or more sound holes 116 which are holes in the instrument body that emit sounds, a tailpiece 118 which anchors the strings 120 at the body 102, a hinge attachment 122 which anchors the cantilevered bridge lever arm 104 to a pivot point, and a neck 124.

Figure 10:
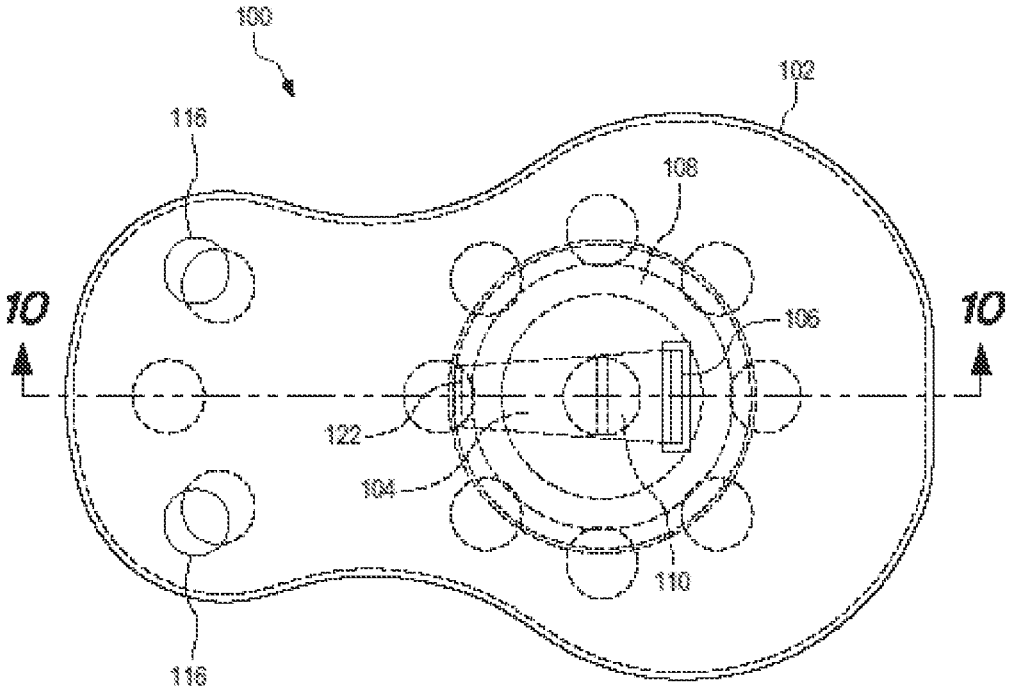
FIG. 10 illustrates a top down view of a guitar body including a single resonator, in accordance with a first embodiment of the invention.

FIG. 10 illustrates a top down view of a guitar body including a single resonator, in accordance with a first embodiment of the invention. The sound producing instrument shown in FIG. 10 includes a sound producing instrument 100, an instrument body 102, a cantilevered bridge lever arm 104, a bridge saddle 106 for the strings 120 to rest, a primary resonator 108 which is shown on the bottom in a standard position, a biscuit bridge 110 on top of the primary resonator 108, one or more sound holes 116 which are holes in the instrument body that emit sounds.

Figure 11:
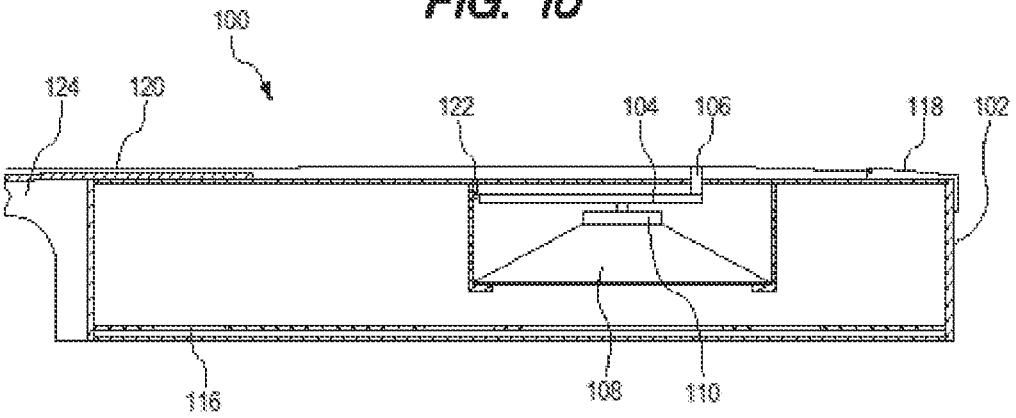
FIG. 11 illustrates a horizontal cross-sectional side view of a single resonator, in accordance with a first embodiment of the invention.

FIG. 11 illustrates a horizontal cross-sectional side view of a single resonator, in accordance with a first embodiment of the invention. The sound producing instrument shown in FIG. 11 includes a sound producing instrument 100, an instrument body 102, a cantilevered bridge lever arm 104, a bridge saddle 106 for the strings 120 to rest, a primary resonator 108 which is shown on the bottom in a standard position, a biscuit bridge 110 on top of the primary resonator 108, one or more sound holes 116 which are holes in the instrument body that emit sounds, a tailpiece 118 which anchors the strings 120 at the body 102, a hinge attachment 122 which anchors the cantilevered bridge lever arm 104 to a pivot point, and a neck 124.

Figure 12:
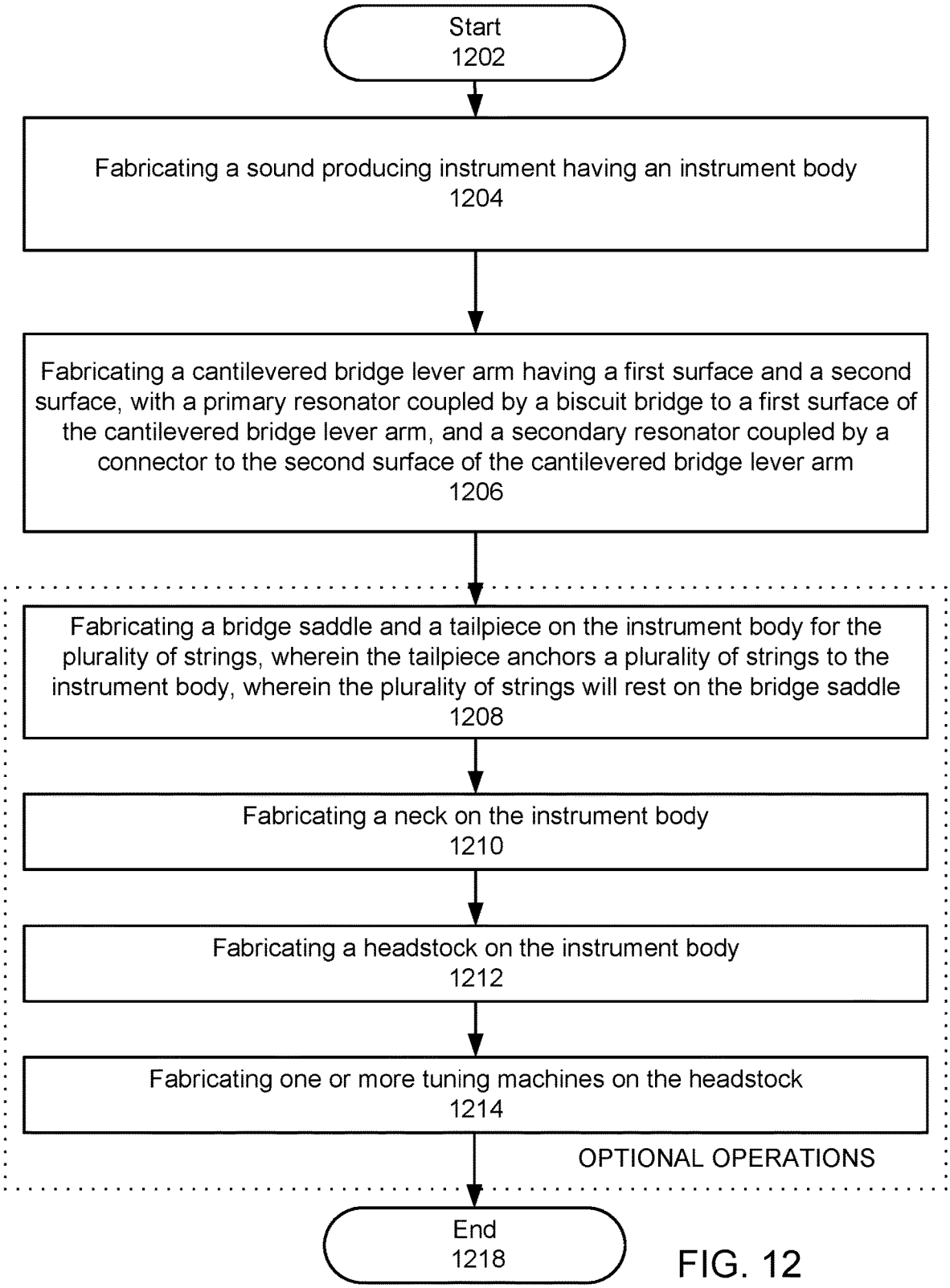
FIG. 12 illustrates a flowchart for a method for fabricating a sound producing instrument having a cantilevered bridge lever arm, in accordance with a first embodiment of the invention.

FIG. 12 illustrates a flowchart for a method for fabricating a sound producing instrument having a cantilevered bridge lever arm, in accordance with a first embodiment of the invention. The method begins in operation 1202. Operation 1204 is next and includes fabricating a sound producing instrument having an instrument body. Operation 1206 is next and includes fabricating a cantilevered bridge lever arm having a first surface and a second surface, with a primary resonator coupled by a biscuit bridge to a first surface of the cantilevered bridge lever arm, and a secondary resonator coupled by a connector to the second surface of the cantilevered bridge lever arm. At this point the sound producing instrument could be either a musical instrument or a loudspeaker with at least one active speaker resonator. From this point, the following operations are optional and would apply to musical instruments, including stringed instruments, including guitars. Operation 1208 is next and includes fabricating a bridge saddle and a tailpiece on the instrument body for the plurality of strings, wherein the tailpiece anchors a plurality of strings to the instrument body, wherein the plurality of strings will rest on the bridge saddle. Operation 1210 is next and includes fabricating a neck on the instrument body. Operation 1212 is next and includes fabricating a headstock on the instrument body. Operation 1214 is next and includes fabricating one or more tuning machines on the headstock. The method ends in operation 1218.

Figure 13:
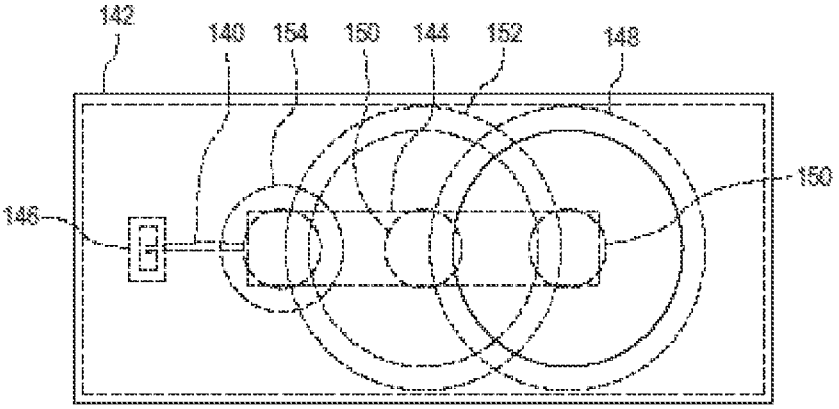
FIG. 13 illustrates a top down view of a cantilevered bridge for resonators, in accordance with another embodiment of the invention.

FIG. 13 illustrates a top down view of a cantilevered bridge for resonators, in accordance with another embodiment of the invention. In this embodiment, the instrument body is a cabinet body enclosure 142 that includes electrical wires 140, cantilevered bridge lever arm 144, signal input jack 146, primary resonator 148, biscuit bridge 150, secondary resonator 152 and an electromagnetic driver 154. In one embodiment, primary resonator 148 and/or secondary resonator 152 would be coupled to the cantilevered bridge lever arm 144 through a custom-built transducer or a commercial transducer (not shown) to convert mechanical movements of the cantilevered bridge lever arm 144 to create sound waves.

Figure 14:
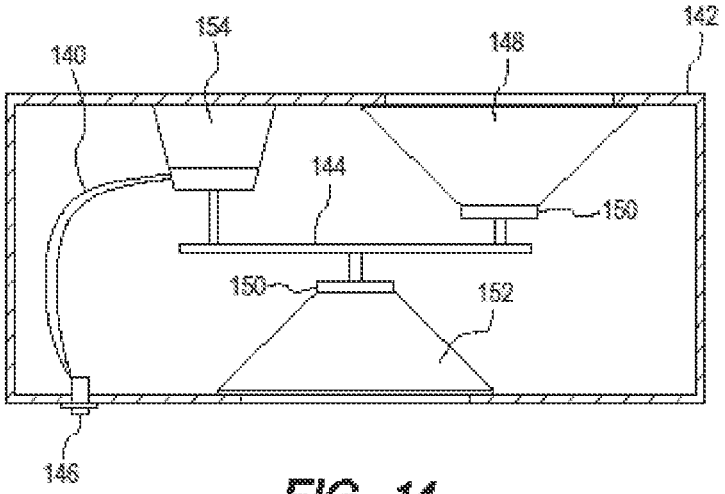
FIG. 14 illustrates a side view of a cantilevered bridge for resonators, in accordance with another embodiment of the invention.

FIG. 14 illustrates a side view of a cantilevered bridge for resonators, in accordance with another embodiment of the invention. This is a side view of FIG. 13 and this embodiment of an instrument body is a cabinet body enclosure 142 that includes electrical wires 140, cantilevered bridge lever arm 144, signal input jack 146, primary resonator 148, biscuit bridge 150, secondary resonator 152 and an electromagnetic driver 154.

Figure 15:
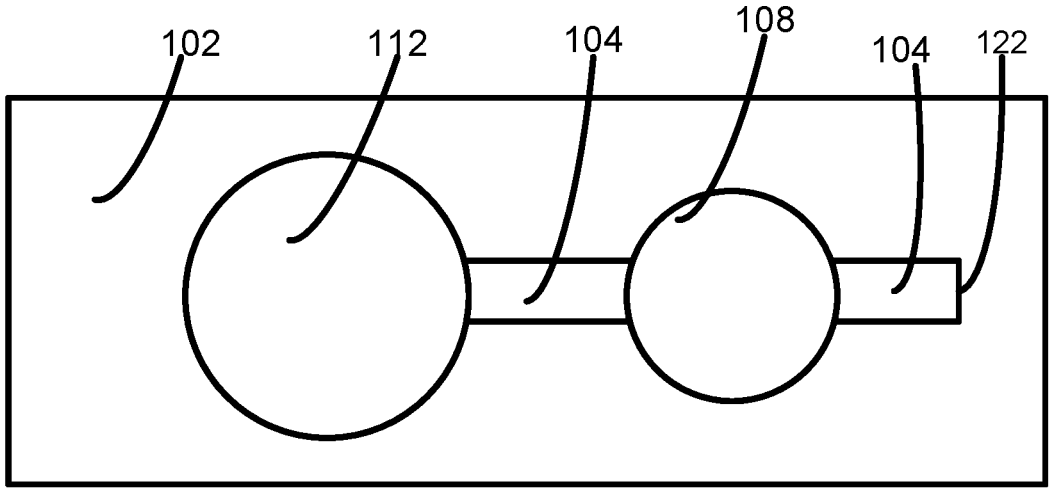
FIG. 15 illustrates a top down view of a cantilevered bridge for resonators, in accordance with another embodiment of the invention.

FIG. 15 illustrates a top down view of a cantilevered bridge for resonators, in accordance with another embodiment of the invention. In this embodiment, the instrument body 102 is an active loudspeaker box. The cantilevered bridge includes a cantilevered bridge lever arm 104, a biscuit bridge 110 (shown in FIG. 16) used to attach the cantilevered bridge lever arm 104 to a primary resonator 108, a secondary resonator 112 and a connector 114 (e.g., screw, nail, pin or equivalent, shown in FIG. 16) to secure the secondary resonator 112 to the end of the cantilevered bridge lever arm 104. On the opposite end of the cantilevered bridge lever arm 104 is the hinge attachment 122 that couples to a pivot point on the instrument body 102. In this embodiment, the primary resonator 108 is an active loudspeaker resonator connected to electrical signal leads 140 (shown in FIG. 16).

Figure 16:
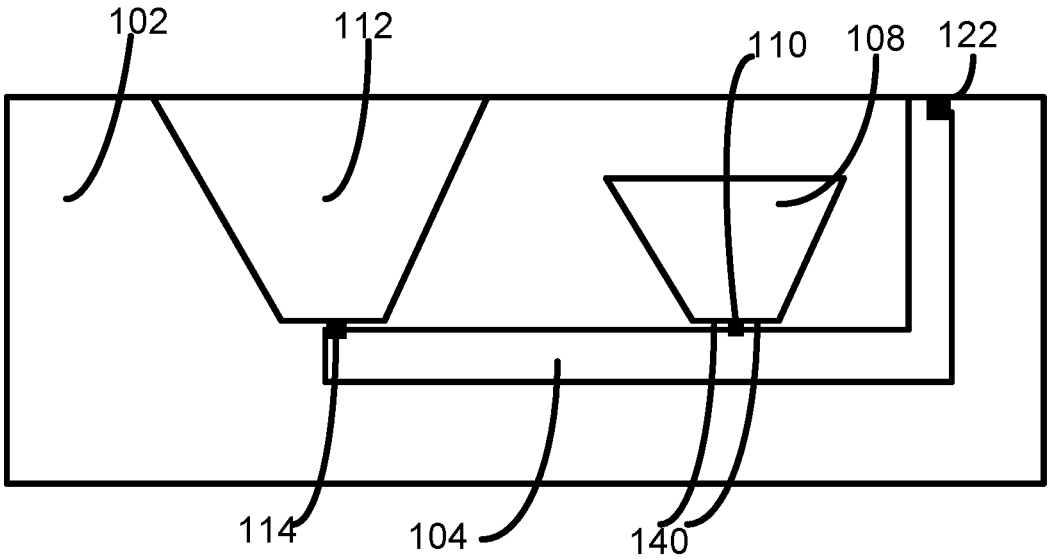
FIG. 16 illustrates a side view of a cantilevered bridge for resonators, in accordance with another embodiment of the invention.

FIG. 16 illustrates a side view of a cantilevered bridge for resonators, in accordance with another embodiment of the invention. This is a side view of FIG. 15. The cantilevered bridge includes a cantilevered bridge lever arm 104, a biscuit bridge 110 (shown in FIG. 15) used to attach the cantilevered bridge lever arm 104 to a primary resonator 108, a secondary resonator 112 and a connector 114 (e.g., screw, nail, pin or equivalent, shown in FIG. 15) to secure the secondary resonator 112 to the end of the cantilevered bridge lever arm 104. On the opposite end of the cantilevered bridge lever arm 104 is the hinge attachment 122 that couples to a pivot point on the instrument body 102. In this embodiment, the primary resonator 108 is an active loudspeaker resonator connected to electrical signal leads 140.

In various embodiments, the cantilevered bridge lever arm and the instrument body can be fabricated from a wide variety of materials including plastics, wood, and various metals and metal alloys. While some embodiments of the invention can comprise commercially available aluminum resonators, various embodiments can transfer sound to every variety and type of resonant chamber or diaphragm. Resonators can be made from a wide variety of materials including plastics, wood, and various metals and metal alloys. Commercial suppliers of resonators include the following: StewMac, with corporate headquarters at 21 North Shafer Street, Athens, Ohio 45701; Beard Guitars, with corporate headquarters at 21736 Leitersburg Pike, Hagerstown, Md. 21742; and National Reso-Phonic Guitars, with corporate headquarters at San Luis Obispo, Calif., with a website at nationalguitars.com.

Some embodiments of the invention can comprise commercially available active speakers for one or more resonators. Commercial suppliers of active speakers include the following: JBL (DBA Harman Professional), with corporate headquarters at 8500 Balboa Boulevard, Northridge, Calif. 91329; Jensen speakers are available from Amplified Parts, with corporate headquarters at 6221 S. Maple Ave, Tempe, Ariz. 85283; and Bose Corporation, with corporate headquarters at 100 The Mountain Road, Framingham, Mass. 01701.

Some embodiments of the invention can comprise commercially available transducers to produce sound. Some potential suppliers include the following: JBL (DBA Harman Professional), with corporate headquarters at 8500 Balboa Boulevard, Northridge, Calif. 91329; Amplified Parts, with corporate headquarters at 6221 S. Maple Ave, Tempe, Ariz. 85283; Polk Audio with corporate headquarters at San Diego, Calif.; Cerwin-Vega with corporate headquarters at 772 S. Military Trail, Deerfield Beach, Fla. 33312; Pioneer Electronics with corporate headquarters at 2050 W. 190th Street, Suite 100, Torrance, Calif. 90504 and Kenwood with corporate headquarters at JVCKenwood USA, P.O. Box 22745, Long Beach, Calif. 90801.

Several embodiments of the invention are possible. The phrase "in one embodiment" used in the specification can refer to a new embodiment, a different embodiment disclosed elsewhere in the application, or the same embodiment disclosed earlier in the application. The exemplary embodiments described herein are for purposes of illustration and are not intended to be limiting. Therefore, those skilled in the art will recognize that other embodiments could be practiced without departing from the scope and spirit of the claims set forth below.

What is claimed is:

1. A sound producing instrument having a cantilevered bridge for a plurality of resonators comprising:

a sound producing instrument;

a cantilevered bridge lever arm having a first surface and a second surface, with a primary resonator coupled by a biscuit bridge to the first surface of the cantilevered bridge lever arm, and a secondary resonator coupled by a connector to the second surface of the cantilevered bridge lever arm.

2. The sound producing instrument having a cantilevered bridge for resonators of claim 1, further comprising:

an instrument body having one or more holes, wherein a hinge attachment anchors the cantilevered bridge lever arm to a pivot point inside the instrument body.

3. The sound producing instrument having a cantilevered bridge for resonators of claim 2, further comprising:

a bridge saddle to support a plurality of strings;

a tailpiece on the instrument body for the plurality of strings, wherein the tailpiece anchors a plurality of strings to the instrument body, wherein the plurality of strings will rest on the bridge saddle;

a neck on the instrument body;

a headstock on the instrument body; and one or more tuning machines on the headstock.

4. The sound producing instrument having a cantilevered bridge for resonators of claim 1, wherein the primary resonator and the secondary resonator are coupled to the cantilevered bridge lever arm in a Class 1 lever configuration, where the primary resonator is the fulcrum and the secondary resonator is the load.

5. The sound producing instrument having a cantilevered bridge for resonators of claim 1, wherein the primary resonator and the secondary resonator are coupled to the cantilevered bridge lever arm in a Class 2 lever configuration, wherein a hinge attachment anchors the cantilevered bridge lever arm to a pivot point within the sound producing instrument and wherein the hinge attachment is the fulcrum, the biscuit bridge is the load and the bridge saddle that supports the strings is the effort.

6. The sound producing instrument having a cantilevered bridge for resonators of claim 1, wherein the primary resonator and the secondary resonator are coupled to the cantilevered bridge lever arm in a Class 3 lever configuration, wherein a hinge attachment anchors the cantilevered bridge lever arm to a pivot point within the sound producing instrument and where the hinge attachment is the fulcrum, the bridge saddle is the effort and the biscuit bridge is the load.

7. The sound producing instrument having a cantilevered bridge for resonators of claim 1, wherein the primary resonator and the secondary resonator are coupled to the cantilevered bridge lever arm, and either the primary resonator or the secondary resonator is an active loudspeaker resonator coupled to a plurality of electrical wires.

8. A sound producing instrument having a cantilevered bridge for resonators comprising:

a sound producing instrument having an instrument body; and a cantilevered bridge lever arm having a first surface and a second surface, with a primary resonator coupled by a biscuit bridge to a first surface of the cantilevered bridge lever arm, and a secondary resonator coupled by a connector to either the first surface or the second surface of the cantilevered bridge lever arm.

9. The sound producing instrument having a cantilevered bridge for resonators of claim 8, further comprising:

a bridge saddle to support a plurality of strings;

a tailpiece on the instrument body for the plurality of strings, wherein the tailpiece anchors a plurality of strings to the instrument body, wherein the plurality of strings will rest on the bridge saddle, and wherein a hinge attachment anchors the cantilevered bridge lever arm to a pivot point within the instrument body;

a neck on the instrument body;

a headstock on the instrument body; and one or more tuning machines on the headstock.

10. The sound producing instrument having a cantilevered bridge for resonators of claim 8, wherein the primary resonator and the secondary resonator are coupled to the cantilevered bridge lever arm in a Class 1 lever configuration, where the primary resonator is the fulcrum and the secondary resonator is the load.

11. The sound producing instrument having a cantilevered bridge for resonators of claim 9, wherein the primary resonator and the secondary resonator are coupled to the cantilevered bridge lever arm in a Class 2 lever configuration, where the hinge attachment is the fulcrum, the biscuit bridge is the load and the bridge saddle that supports the strings is the effort.

12. The sound producing instrument having a cantilevered bridge for resonators of claim 9, wherein the primary resonator and the secondary resonator are coupled to the cantilevered bridge lever arm in a Class 3 lever configuration, where the hinge attachment is the fulcrum, the bridge saddle is the effort and the biscuit bridge is the load.

13. The sound producing instrument having a cantilevered bridge for resonators of claim 8, further comprising an electromagnetic driver and a plurality of electrical wires, wherein the primary resonator and the secondary resonator are coupled to the cantilevered bridge lever arm and the primary resonator and secondary resonator include a transducer to convert mechanical movements induced by the electromagnetic driver into soundwaves.

14. The sound producing instrument having a cantilevered bridge for resonators of claim 8, wherein the sound producing instrument is a loudspeaker and at least one resonator is an active speaker resonator coupled to a plurality of electrical wires.

15. A method for fabricating a sound producing instrument having a cantilevered bridge lever arm comprising:

fabricating a sound producing instrument having an instrument body; and fabricating a cantilevered bridge lever arm having a first surface and a second surface, with a primary resonator coupled by a biscuit bridge to a first surface of the cantilevered bridge lever arm, and a secondary resonator coupled by a connector to either the first surface or the second surface of the cantilevered bridge lever arm.

16. The method for fabricating a sound producing instrument having a cantilevered bridge lever arm of claim 15, further comprising:

fabricating a bridge saddle and a tailpiece on the instrument body for the plurality of strings, wherein the tailpiece anchors a plurality of strings to the instrument body, wherein the plurality of strings will rest on the bridge saddle;

fabricating a neck on the instrument body;

fabricating a headstock on the instrument body; and fabricating one or more tuning machines on the headstock.

17. The method for fabricating a sound producing instrument having a cantilevered bridge lever arm of claim 15, wherein the primary resonator and the secondary resonator are coupled to the cantilevered bridge lever arm in a Class 1 lever configuration, where the primary resonator is the fulcrum and the secondary resonator is the load.

18. The method for fabricating a sound producing instrument having a cantilevered bridge lever arm of claim 15, wherein a hinge attachment anchors the cantilevered bridge lever arm to a pivot point within the sound producing instrument and wherein the primary resonator and the secondary resonator are coupled to the cantilevered bridge lever arm in a Class 2 lever configuration, where the hinge attachment is the fulcrum, the biscuit bridge is the load and the bridge saddle that supports the strings is the effort.

19. The method for fabricating a sound producing instrument having a cantilevered bridge lever arm of claim 15, wherein a hinge attachment anchors the cantilevered bridge lever arm to a pivot point within the sound producing instrument wherein the primary resonator and the secondary resonator are coupled to the cantilevered bridge lever arm in a Class 3 lever configuration, where the hinge attachment is the fulcrum, the bridge saddle is the effort and the biscuit bridge is the load.

20. The method for fabricating a sound producing instrument having at cantilevered bridge lever arm and at least two resonators of claim 15, wherein the sound producing instrument is a loudspeaker and at least one resonator is an active speaker resonator coupled to a plurality of electrical wires.

* * * * *